US007755035B2

(12) United States Patent
Nakamura et al.

(10) Patent No.: US 7,755,035 B2
(45) Date of Patent: Jul. 13, 2010

(54) ION TRAP TIME-OF-FLIGHT MASS SPECTROMETER

(75) Inventors: Hiroshi Nakamura, Hitachinaka (JP); Tsukasa Shishika, Mito (JP); Yasushi Terui, Tsuchiura (JP); Takuya Saeki, Hitachinaka (JP)

(73) Assignee: Hitachi High-Technologies Corporation, Tokyo (JP)

( * ) Notice: Subject to any disclaimer, the term of this patent is extended or adjusted under 35 U.S.C. 154(b) by 376 days.

(21) Appl. No.: 11/889,264

(22) Filed: Aug. 10, 2007

(65) Prior Publication Data

US 2008/0245962 A1 Oct. 9, 2008

(30) Foreign Application Priority Data

Aug. 30, 2006 (JP) ..... 2006-234176

(51) Int. Cl.
*H01J 49/40* (2006.01)

(52) U.S. Cl. ..... 250/287; 250/281

(58) Field of Classification Search ..... None
See application file for complete search history.

(56) References Cited

U.S. PATENT DOCUMENTS 2,685,035 A 7/1954 Wiley
5,689,111 A 11/1997 Dresch et al.
6,020,586 A 2/2000 Dresch et al.
6,455,845 B1 * 9/2002 Li et al. ..... 250/287
6,507,019 B2 1/2003 Chernushevich et al.
6,627,883 B2 * 9/2003 Wang et al. ..... 250/292
7,019,285 B2 3/2006 Dresch et al.
7,208,728 B2 4/2007 Hashimoto et al.

FOREIGN PATENT DOCUMENTS

JP 2000-516762 12/2000
JP 2003-123685 4/2003
JP 2005-183022 7/2005
KR 2003-123685 4/2003

* cited by examiner

*Primary Examiner*—Jack I Berman
(74) *Attorney, Agent, or Firm*—McDermott Will & Emery LLP

(57) ABSTRACT

An ion trap time-of-flight mass spectrometer capable of obtaining highly-sensitive mass spectra even on the lower mass number side is realized. The ion trap time-of-flight mass spectrometer includes an ion source that operates at atmospheric pressure, an ion optical system for introducing the ions generated by the ion source into a vacuum chamber and converging the ions introduced into the vacuum chamber, an ion trap part for trapping ions in the vacuum chamber, a multipole part for converging the kinetic energy of the ions discharged from the ion trap, and a time-of-flight mass spectrometry part for measuring the ions discharged from the multipole part. The period of high-voltage pulses generated by an electrode provided in the time-of-flight mass spectrometry part can be changed depending on an ion content introduced into the multipole part.

4 Claims, 3 Drawing Sheets

ION TRAP TIME-OF-FLIGHT MASS SPECTROMETER

BACKGROUND OF THE INVENTION

1. Field of the Invention

The present invention relates to an ion trap time-of-flight mass spectrometer comprising an ion trap part for trapping ions and a time-of-flight mass spectrometry part.

2. Background Art

The ion trap time-of-flight mass spectrometer is a mass spectrometer in which an ion trap part and a time-of-flight mass spectrometer are connected, and for example, JP Patent Publication (Kokai) No. 2003-123685 A discloses such a spectrometer.

As a mass spectrometer in the biological field, since the molecular weight of a sample to be measured is large, in many cases, the time-of-flight (TOF) mass spectrometer is used.

The time-of-flight (TOF) mass spectrometer is a technique on which a patent was granted in the United States in 1951 (U.S. Pat. No. 2,685,035), and because of recent advances in electronics, it has become a more familiar mass spectrometer. Thus, such spectrometer is widely used in the biological field and the like.

Particularly in the biological field, an ion trap was introduced, and thus a technique having high mass accuracy and enabling $MS^n$ analysis has been developed.

According to the technique, such ion trap is introduced between an ion source and a time-of-flight (TOF) mass spectrometer, and in this way, ion isolation or ion dissociation can be repeated inside the ion trap, thereby enabling $MS^n$ analysis.

The kinetic energy of the ions discharged from the ion trap is converged in a multipole part, and it is then introduced between a PUSH electrode and a PULL electrode of the time-of-flight (TOF) mass spectrometer.

High-voltage pulses at a constant period are applied to the ions introduced between the PUSH electrode and the PULL electrode, the ions are then introduced into an acceleration region, and as a result, they are accelerated in an orthogonal direction (JP Patent Publication (Kokai) No. 2003-123685 A).

By detecting current values in accordance with ion flight time with an MCP (detecting part), the time-of-flight mass spectrometry for calculating mass spectra is conducted. By disposing an ion introduction direction and acceleration direction so that the directions are orthogonal to each other, high resolution and high mass accuracy can be achieved.

SUMMARY OF THE INVENTION

In such conventional ion trap time-of-flight mass spectrometers, the period of the high-voltage pulses applied to the PUSH electrode of the mass spectrometry part is constant.

However, the ion-content presence distribution in the multipole part located at a subsequent state of the ion trap part exhibits such distribution as shown in FIG. 2(*b*).

Referring to the figure, first, the majority of the ions on the lower mass number side move from the multipole part to the gap between the PUSH electrode and the PULL electrode, and next, gradually, the ions on the higher mass number side move to the gap between the PUSH electrode and the PULL electrode.

Thus, such generation of high-voltage pulses at a constant period results in a phenomenon in which the ion content to be transported varies depending on the mass number.

The present invention realizes an ion trap time-of-flight mass spectrometer capable of obtaining highly-sensitive mass spectra even on the lower mass number side, by changing the period of the high-voltage pulses applied to the PUSH electrode depending on the distribution of the ion content in the multipole part and effectively transporting ions to an MCP (detector).

In order to achieve the above, the present invention is constructed as follows:

(1). The ion trap time-of-flight mass spectrometer according to the present invention comprises: an ion source that operates at atmospheric pressure; an ion optical system for introducing the ions generated in the ion source into a vacuum chamber and converging the ions introduced into the vacuum chamber in an central axis direction; an ion trap part for trapping the ions and generating a cleavage reaction in the vacuum chamber; a multipole part for converging the kinetic energy of the ions discharged from the ion trap part; and a time-of-flight mass spectrometry means for measuring the ions discharged from the multipole part.

(2). Based on the above (1), it is possible to realize an ion trap time-of-flight mass spectrometer capable of obtaining highly-sensitive mass spectra, by changing the period of high-voltage pulses applied to the PUSH electrode depending on the distribution of ion content in the multipole part and efficiently transporting the ions to the MCP(detector).

EFFECTS OF THE INVENTION

In accordance with the present invention, it is possible to realize an ion trap time-of-flight mass spectrometer capable of obtaining more sensitive mass spectra, by changing intervals at which the high-voltage pulses applied to the PUSH electrode are generated and transporting the ions to the MCP more efficiently.

Further, the distribution (FIG. 2) of ion content flowing into the multipole part from the ion trap part is calculated in advance. Thus, in accordance with the expected distribution of the ion content flowing into the multipole part from the ion trap part, the period of the high-voltage pulses applied to the PUSH electrode is controlled. In this way, the ions can be efficiently transported to the MCP (detector), and highly-sensitive mass spectra can be obtained.

DESCRIPTION OF THE PREFERRED EMBODIMENTS OF THE INVENTION

Embodiments of the present invention will be described hereafter with reference to the attached drawings.

Figure 1:
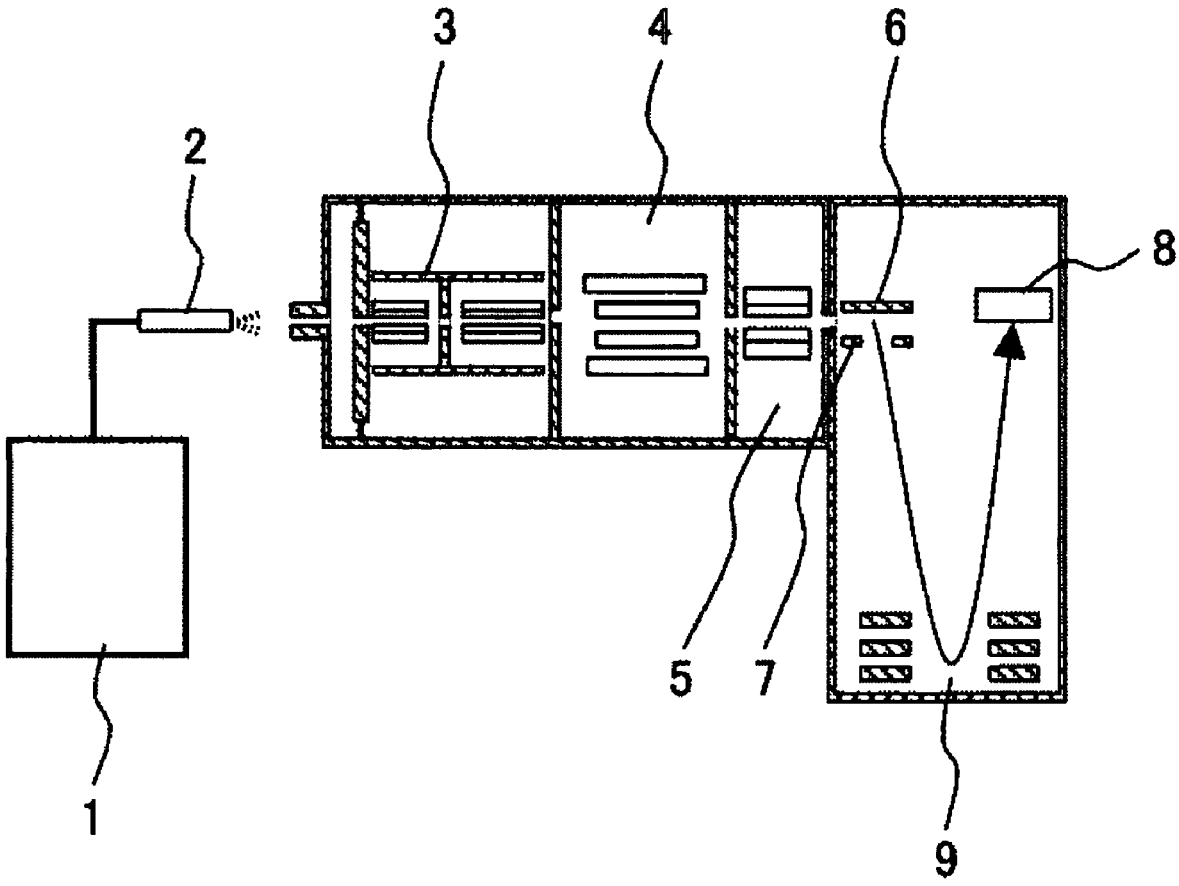
FIG. 1 relates to an embodiment of the present invention, and it schematically shows the structure of an ion trap time-of-flight mass spectrometer.

FIG. 1 schematically shows the structure of an ion trap time-of-flight mass spectrometer as one embodiment of the present invention.

First, the basic operation of the ion trap time-of-flight mass spectrometer will be described.

In FIG. 1, the sample separated by a liquid chromatography system 1 is subject to solvent removal/ionization in an electrospray ion source 2, and it is then introduced into the high-vacuum ion trap time-of-flight mass spectrometer (vacuum chamber).

Next, the ions thus introduced are converged in an ion optical system 3, and they are then introduced into an ion trap part 4 efficiently.

Figure 2:
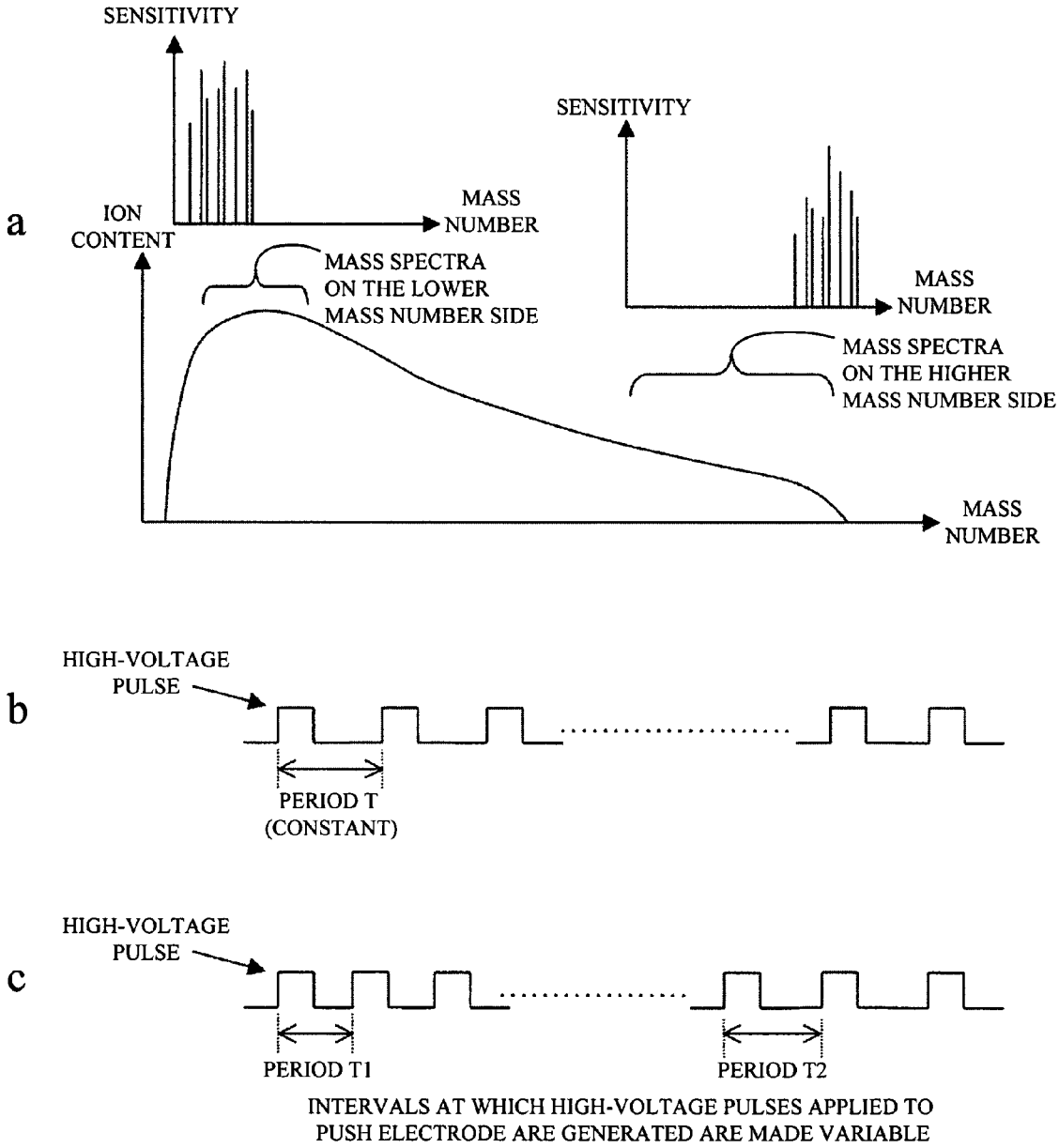
FIG. 2 relates to an embodiment of the present invention; it shows the distribution of the ions in a multipole part and intervals at which high-voltage pulses are generated by a PUSH electrode.

In the ion trap part 4, the ions are trapped, and target ions are selected, so as to conduct cleavage. The distribution of the ion content flowing into a multipole part 5 from the ion trap part 4 is calculated in advance (FIG. 2(*a*)).

The ions are next introduced into the gap between a PUSH electrode 6 and a PULL electrode 7 from the multipole part 5. At this time, the ions on the lower mass number side are first introduced in large quantities. These ions then fly in a time-of-flight mass spectrometry part 9.

At this time, in order to allow the ions to be efficiently transported to an MCP (detector) 8, the period T1 of the high-voltage pulses generated by the PUSH electrode 6 is maximized. Accordingly, the ions on the lower mass number side can be efficiently transported to the MCP (detector) 8.

Next, the ions reaching the PUSH electrode 6 from the multipole part 5 gradually change, from the ions on the lower mass number side to the ions on the higher mass number side. Accordingly, the period of the high-voltage pulses generated by the PUSH electrode 6 is gradually extended from T1 to T2.

In the present embodiment of the present invention, the number of the high-voltage pulses generated is 200 based on the $MS^2$ analysis (a method of analysis in which certain target sample ions are selectively cleaved so as to determine the structure of the target ions based on the mass number of the fragments). If 200 high-voltage pulses are generated at a constant period T as in the conventional method of FIG. 2(*b*), the loss of ions on the lower mass number side is caused.

Namely, the sensitivity is decreased by the amount of such loss. Thus, when the ions on the lower mass number side are present in large quantities, the period of the high-voltage pulses is shortened (FIG. 2(*c*)), and the ions on the lower mass number side are allowed to reach the MCP 8 (detector) efficiently, thereby realizing an ion trap time-of-flight mass spectrometer capable of increasing the sensitivity of the ions on the lower mass number side.

Further, in the present invention, the ion trap part 4 is not limited to a type of ion trap having four columnar electrodes as shown in the schematic diagram of FIG. 1; similarly, a three-dimensional ion trap type comprising a ring electrode rotationally symmetric with respect to the X axis and a pair of end-cap electrodes can also be applied.

Figure 3:
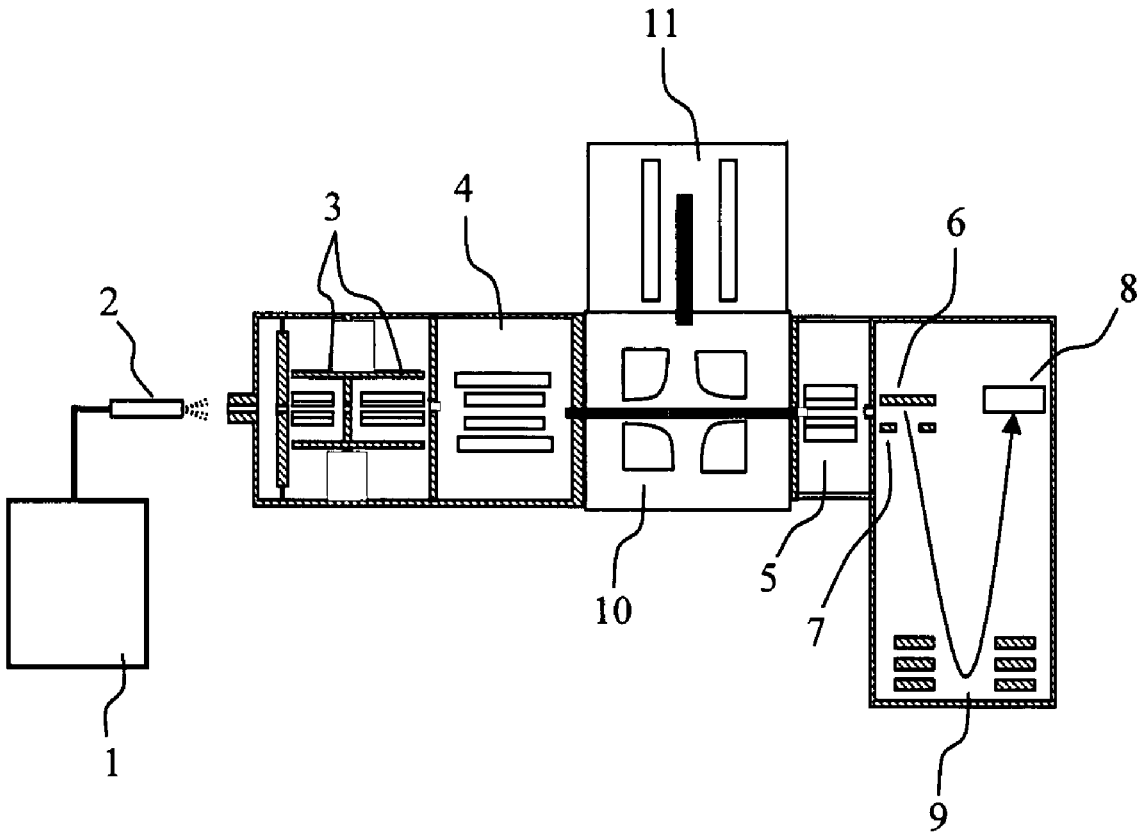
FIG. 3 schematically shows a structure of an embodiment of the present invention; it schematically shows a structure comprising an ECD reaction part 11 and a deflection electrode part 10 that is disposed between the ion trap part 4 and the multipole part 5 of FIG. 1.

Further, as shown in FIG. 3, even when the present invention comprises a deflection electrode part 10 and an ECD (Electron Capture Dissociation) reaction part 11 between the ion trap part 4 and the multipole part 5, the present invention can be applicable, since ions are introduced into the time-of-flight mass spectrometry part 9 through the multipole part 5.

What is claimed is:

1. An ion trap time-of-flight mass spectrometer comprising:

an ion source that operates at atmospheric pressure;

an ion optical system for introducing the ions generated by the ion source into a vacuum chamber and converging the ions introduced into the vacuum chamber;

an ion trap part for trapping ions in the vacuum chamber;

a multipole part for converging the kinetic energy of the ions discharged from the ion trap;

a time-of-flight mass spectrometry part for measuring the ions discharged from the multipole part; and a pulse controller for controlling a period of high-voltage pulses generated by an electrode provided in the time-of-flight mass spectrometry part and changing said period of high-voltage pulses depending on an ion distribution introduced into the multipole part.

2. The ion trap time-of-flight mass spectrometer according to claim 1, wherein, when many ions on the lower mass number side are present, the period of high-voltage pulses is shortened.

3. The ion trap time-of-flight mass spectrometer according to claim 1, wherein the period of high-voltage pulses can be continuously changed based on a previously calculated ion distribution.

4. The ion trap time-of-flight mass spectrometer according to claim 2, wherein the period of high-voltage pulses can be continuously changed based on a previously calculated ion distribution.

* * * * *